United States Patent [19]

Ichihashi et al.

[11] Patent Number: 4,590,494

[45] Date of Patent: May 20, 1986

[54] MULTICOLOR RECORDING APPARATUS

[75] Inventors: Hiroo Ichihashi; Shigeo Toganoh; Yohji Matsufuji, all of Tokyo, Japan

[73] Assignee: Canon Kabushiki Kaisha, Tokyo, Japan

[21] Appl. No.: 558,983

[22] Filed: Dec. 7, 1983

[30] Foreign Application Priority Data

Dec. 15, 1982 [JP] Japan ..... 57-219528

[51] Int. Cl.[4] ..... G01D 15/18

[52] U.S. Cl. ..... 346/140 R; 346/75

[58] Field of Search ..... 346/140 PD, 75

[56] References Cited

U.S. PATENT DOCUMENTS

| | | | |
|---|---|---|---|
| 4,038,667 | 7/1977 | Hou et al. | 346/140 PD |
| 4,320,406 | 3/1982 | Heinzl | 346/140 PD |
| 4,342,042 | 7/1982 | Cruz-Uribe et al. | 346/140 PD |
| 4,380,771 | 4/1983 | Takatori | 346/140 PD |
| 4,437,104 | 3/1984 | Hudson | 346/140 PD |

*Primary Examiner*—George H. Miller, Jr.

*Attorney, Agent, or Firm*—Fitzpatrick, Cella, Harper & Scinto

[57] ABSTRACT

A multicolor recording apparatus having a plurality of independently drivable recording devices of the same color is provided with a distributor for distributing and supplying a recording liquid of the same color to the plurality of recording devices of the same color.

8 Claims, 6 Drawing Figures

FIG. 4 (1)
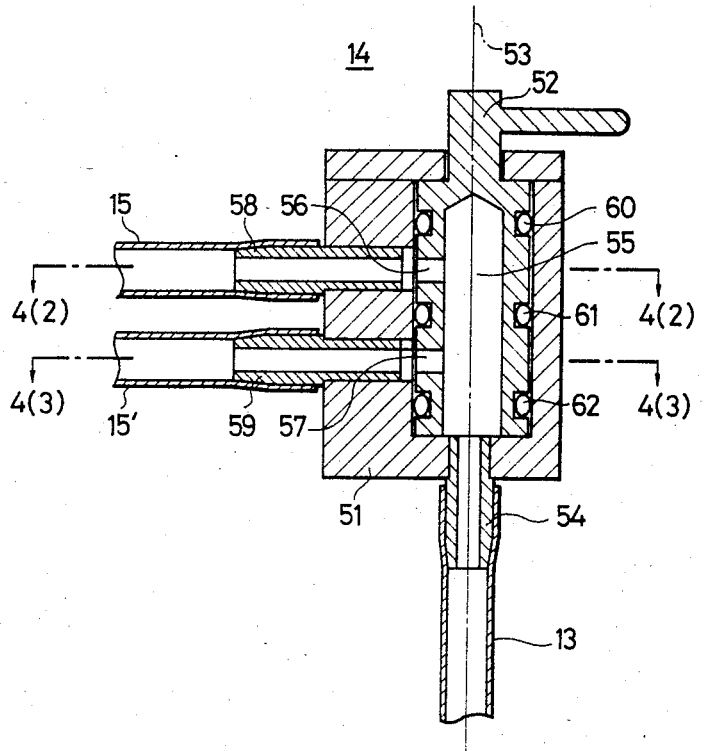
FIG. 4 (2)
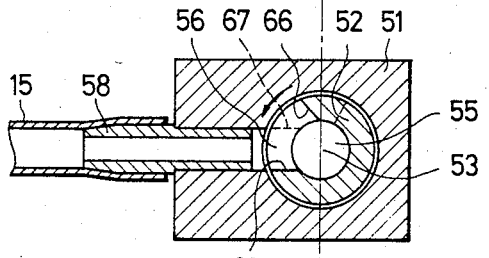
FIG. 4 (3)
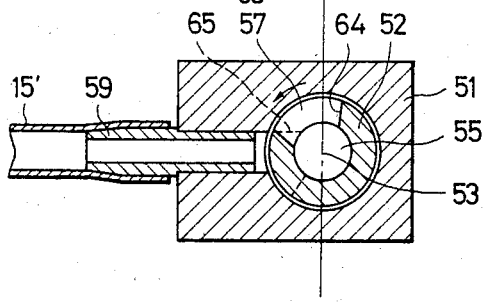

MULTICOLOR RECORDING APPARATUS

BACKGROUND OF THE INVENTION

1. Field of the Invention

This invention relates to a multicolor recording apparatus, and in particular to improvements in an ink supply system for supplying ink to the recording means thereof.

2. Description of the Prior Art

A multicolor recording apparatus, for example, a color ink jet printer, has a plurality of ink jet heads discharging yellow (Y), magenta (M), cyan (C) and black (B) inks and effects recording of colored images, but some printers are provided with a plurality of ink jet heads discharging ink of the same color. In such printers, it is necessary to construct an ink supply system capable of supplying ink simply and properly from ink tanks of distinct colors to the plurality of ink jet heads of the same color.

SUMMARY OF THE INVENTION

In view of this point, it is an object of the present invention to provide a multicolor recording apparatus having a plurality of independently operable recording means of the same color and provided with an ink supply system which is capable of effecting proper ink supply to each recording means and which is excellent in maintenance and check-up characteristics.

It is another object of the present invention to provide a multicolor recording apparatus having a plurality of independently drivable recording means of the same color and provided with a distributor for distributing and supplying a recording liquid of the same color to the plurality of recording means of the same color.

The invention will become fully apparent from the following detailed description thereof taken in conjunction with the accompanying drawings.

BRIEF DESCRIPTION OF THE DRAWINGS

FIG. 4(1) is a cross-sectional view of the distributor of FIG. 1.

FIGS. 4(2) and 4(3) are cross-sectional views of the distributor of FIG. 4(1) taken along lines 4-(2) and 4-(3), respectively, of FIG. 4(1).

DESCRIPTION OF THE PREFERRED EMBODIMENT

Figure 1:
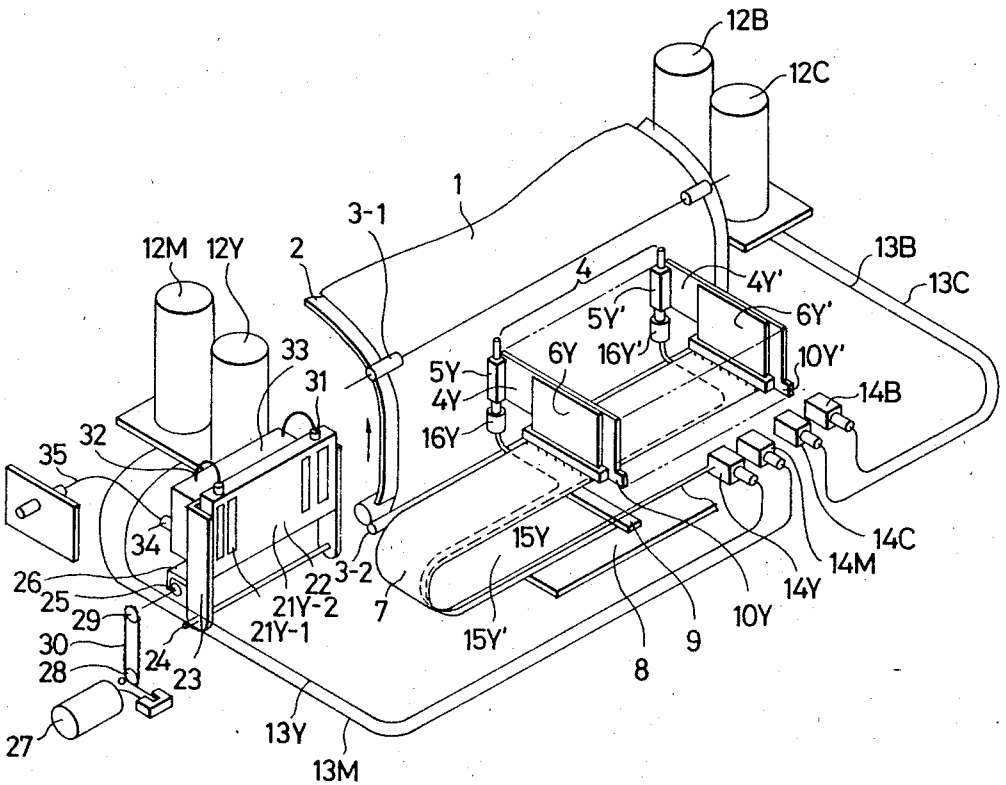
FIG. 1 schematically shows the construction of an embodiment of the present invention.

FIG. 1 schematically shows the construction of a multicolor ink jet printer to which the present invention is applied. In FIG. 1, reference numeral 1 designates recording paper, reference numeral 2 denotes a platen, and reference numeral 3-1 designates a pinch roller for urging the recording paper 1 against the platen 2. The recording paper 1 may be moved in the minor scanning direction (the direction of the arrow) on the platen 2 by rotation of a paper feed roller 3-2. Reference numeral 4 designates a group of head units comprising multinozzle ink jet heads disposed in opposed relationship with the recording paper 1. Head units 4Y, 4M, 4C, 4B, 4B', 4C', 4M' and 4Y' which discharge inks of respective colors in the order of Y, M, C, B, B, C, M and Y in the major scanning direction from the left-hand side of FIG. 1 are arranged at predetermined intervals. In FIG. 1, only the head units 4Y and 4Y' on the opposite sides are shown. Each head unit has a plurality of, say, 128 nozzles arranged at predetermined intervals in the minor scanning direction and discharges ink of a distinct color toward the recording paper 1. Reference numeral 5 designates a liquid chamber communicating with each nozzle. Reference numeral 6 denotes a matrix circuit for selectively driving each nozzle, reference numeral 7 designates a flexible cable, and reference numeral 8 denotes a head driving circut. A head driving signal may be supplied from the head driving circuit 8 to the matrix circuit 6 through the cable 7. Reference numeral 9 designates a pressure plate for connecting and fixing the output terminal of the head driving circuit 8 and each terminal of the flexible cable 7. The matrix circuit 6 is disposed in each unit, and the group of head units 4 is fixed to a carriage, not shown, by a head fixing plate 10 (see FIG. 3). The carriage may be guided along a slide shaft by well known drive means such as a driving belt and reciprocally moved in the major scanning direction on the recording paper 1.

Description will now be made of an ink supply system for supplying ink to each head unit.

Reference characters 12Y, 12M, 12C and 12B designate ink reservoirs storing therein inks of colors Y, M, C and B, respectively, and reference characters 13Y, 13M, 13C and 13B denote ink pipes communicating at one end thereof with the ink tanks. Reference characters 14Y, 14M, 14C and 14B designate distributors communicating with the other ends of the ink pipes 13Y–13B, respectively. Inks of distinct colors may be supplied to the distributors 14Y–14B through the ink pipes 13Y–13B, respectively. Reference characters 15Y and 15Y' designate ink pipes communicating at one end thereof with the distributor 14Y, and reference characters 16Y and 16Y' denote liquid entry couplers for communicating the other ends of the ink pipes 15Y and 15Y' with the liquid chambers 5Y and 5Y', respectively, of the head units 4Y and 4Y'. The yellow ink supplied to the distributor 14Y, as will later be described, may be distributed into the ink pipes 15Y and 15Y' and supplied to the liquid chambers 5Y and 5Y' through the ink pipes 15Y and 15Y', respectively. Although not shown, under a similar construction, inks of distinct colors may be supplied from the distributors 14M, 14C and 14B to the corresponding head units 4M, 4M', 4C, 4C', 4B and 4B'.

A recovering system will now be described.

Reference character 21Y-1 designates a rubber cap and reference character 21Y-2 denotes a cleaning pad, and a number of sets of these two members corresponding to the head units 4Y–4Y', namely, eight sets, are arranged on a holder 22. In a condition in which the group of head units 4 has returned to a first home position, the heads of the head units 4Y–4Y' are made to confront the rubber caps 21Y-1–21Y'-1, and in a condition in which the group of head units 4 has returned to a second home position, the heads are made to confront the cleaning pads 21Y-2–21Y'-2. Reference numeral 23 designates a support plate for supporting the holder 22, and reference numeral 24 denotes a fixed shaft for pivotably supporting the support plate 23. Reference numeral 25 designates an eccentric roller. The side surface of the support plate 23 has a bearing portion 26 designed to engage the roller 25, and the support plate 23 is adapted to pivot in a predetermined range of angle about the fixed shaft 24 by rotation of the eccentric roller 25. Reference numeral 27 designates a motor, reference numeral 28 denotes a pulley secured to the output shaft of the motor, reference numeral 29 designates a pulley secured to the rotary shaft of the eccentric roller 25, and reference numeral 30 denotes a drive force transmitting belt passed over the pulleys 28 and 29. Under such a construction, the motor 27 may be energized to rotate the eccentric roller 25.

The position of the support plate 23 prescribed by the eccentric roller 25, that is, the surface position of the rubber caps 21Y-1–21Y'-1 and the cleaning pads 21Y-2–21Y'-2, is made to lie on the same plane as the recording paper 1 or on a plane retracted therefrom relative to the group of head units 4 when the group of head units 4 is not in its home position, and is made to bear against the surface of the heads of the group of head units 4 with a predetermined pressure when the group of head units 4 has returned to its home position. As a result, when the group of head units has returned to the first home position, the nozzles are closed by the rubber caps 21Y-1–21Y'-1 and thus, occurrence of evils such as desiccation of the tip ends of the nozzles and entry of dust or the like thereinto may be avoided. When the group of head units has returned to the second home position, the tip ends of the nozzles of the head units 4Y–4Y' are cleaned by the cleaning pads 21Y-2–21Y'-2 and thus, an evil such as the instruments around the nozzles being contaminated by drops of ink unnecessarily extruded from the tip ends of the nozzles may be avoided.

The details of each constructional region will now be described.

Figure 2:
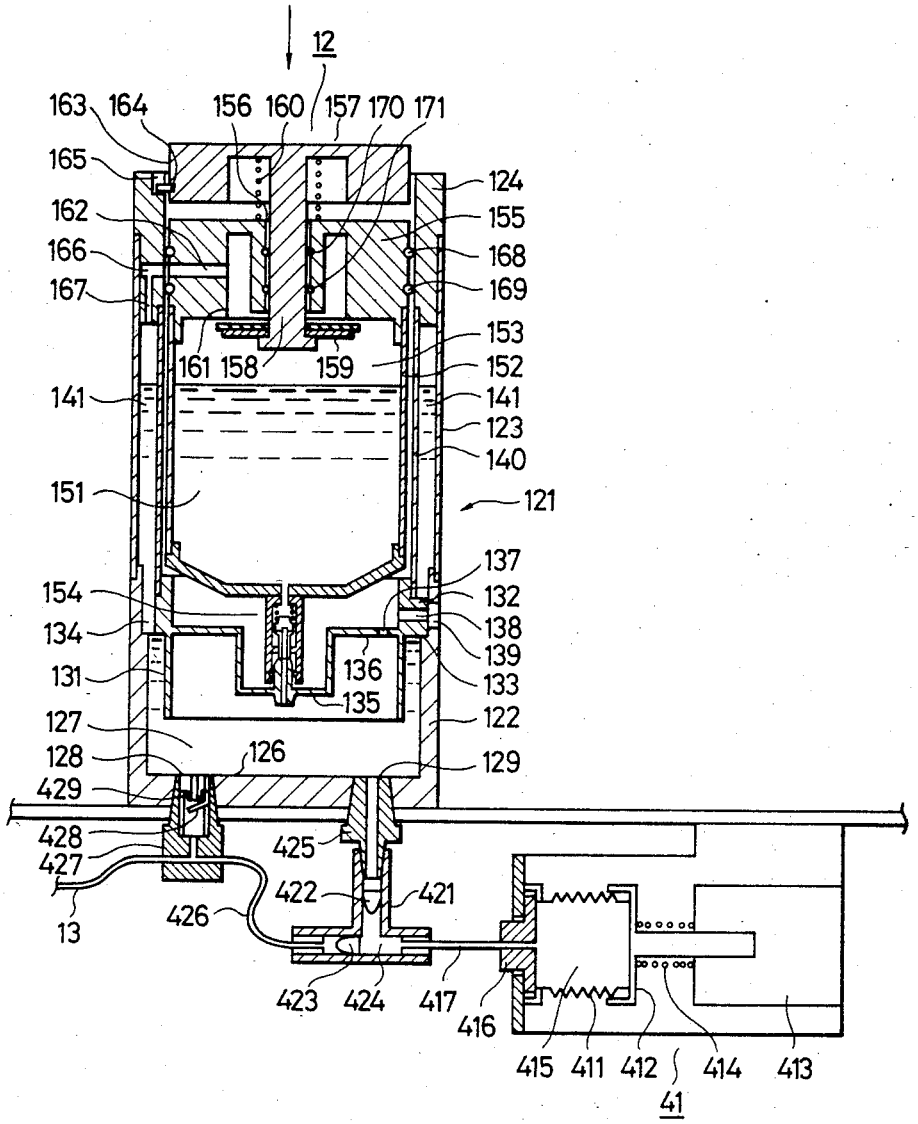
FIG. 2 shows the construction of an ink reservoir and a plunger pump in the ink supply system of FIG. 1.

FIG. 2 shows the ink reservoir unit 12(12Y–12B) of the ink supply system in the printer of FIG. 1 and an ink pump (plunger pump) for pressurizing supplied ink for the loading or recovery of ink into the ink jet heads.

In the ink reservoir unit 12, reference numeral 121 designates a main tank. Reference numerals 122, 123 and 124 denote circular rings constituting the outer shell of the main tank. The circular ring 122 has a bottom plate 126 and forms an ink reservoir 127. The bottom plate 126 is formed with ink supply holes 128 and 129 in which check valves are fitted as will later be described. Reference numeral 131 designates a circular ring which constitutes a main tank lid and which has an outside diameter smaller than the inside diameter of the circular ring 122. The circular ring 131 is inserted in the circular ring 122 so as to be coaxial with the outer shell defined by elements 122, 123 and 124. The outer peripheral wall of the circular ring 131 is formed with protrusions 132 at predetermined intervals, and these protrusions are restrained by the flange portion 133 formed on the inner peripheral wall of the circular ring 22. As a result, a passage 134 communicating with the ink reservoir 127 is formed by the inner peripheral wall of the circular ring 122 and the outer peripheral wall of the circular ring 131. Further, the circular ring 131 has a lid portion 136 formed with a downward protruding surface 135 centrally thereof, and this lid portion 136 is formed with a communication hole 137, from which the atmosphere may be introduced into the ink reservoir 127 through a communication hole 138 formed in the protrusion 132 and an atmosphere hole 139 formed in the circular ring 122 of the outer shell. One of couplers for introducing ink from a supplemental tank to be described into the ink reservoir 127 is disposed on the protruded surface 135 of the lid portion 136 coaxially with the circular ring 131.

Reference numeral 140 designates a circular ring constituting the inner shell of the main tank. One end of the circular ring 140 is fitted to the circular ring 131 and the other end of the circular ring 140 is fitted to the circular ring 124, and a passage 141 communicating with the passage 134 is formed between the circular ring 140 and the outer shell 125.

Designated by 151 is a supplemental tank which is removably mountable into the main tank 121 in the direction of the arrow. In FIG. 2, the supplemental tank 151 is shown mounted in the main tank 121. Reference numeral 152 designates an outer shell forming the ink reservoir 153 of the supplemental tank. One of couplers 154 for introducing the ink in the ink reservoir 153 into the main tank is disposed in the lower end portion of the outer shell 152, and when the supplemental tank is mounted, one of the couplers 154 disposed on the main tank lid 131 as shown is fitted to the supplemental tank. A through-hole 156 is formed in the rear end portion 155 of the outer shell 152. Reference numeral 157 designates a supplemental tank lid having a sliding shaft 158 inserted in the through-hole 156. A rubber packing 159 is secured to the tip end portion of the sliding shaft 158 which projects into the ink reservoir 153, and a spring 160 is interposed between the supplemental tank lid 157 and the rear end portion 155 of the outer shell 152 to urge the lid 157 away from the rear end portion 155. Thus, when the supplemental tank 151 is not mounted, the rubber packing 159 is brought into intimate contact with a flange portion 161 formed on the rear end portion 155. Accordingly, a communication hole 162 formed in the rear end portion 155 and the ink reservoir 153 can be isolated from each other, so that the supplemental ink in the ink reservoir 153 never leaks to the outside through the communication hole 162.

Pins 164 are secured to the outer peripheral wall 163 of the supplemental tank lid 157 at predetermined intervals and pin-receiving grooves 165 are formed in the end portion of the inner peripheral wall of the circular ring 124 of the main tank 121. These grooves 165 extend in the vertical direction (the direction perpendicular to the plane of the drawing sheet) to form pin-securing portions. Thus, when the supplemental tank 151 is inserted in the main tank 121, if the supplemental tank lid 157 is urged and moved against the force of the spring 160 so that the pins 164 are inserted in the pin-receiving grooves 165 and further, the supplemental tank lid 157 is rotated about the axis thereof toward the pin-securing portions of the grooves 165, the pins 163 are restrained on the pin-securing portions and therefore, the supplemental tank lid 157 is held with the rubber packing 159 being spaced apart from the flange portion 161 as shown. As a result, the ink reservoir 153 communicates with the communication hole 162. A communication hole 166 communicating with the communication hole 162 is formed in the circular ring 124 of the main tank 121, and further, a communication hole 167 communicating the communication hole 166 with the passage 141 is formed in the circular ring 124.

Designated by 168, 169 and 170, 171 are O-rings which respectively seal the space between the inner peripheral wall of the circular ring 124 of the ink tank and the supplemental tank 151 inserted therein and the space between the through-hole 156 of the supplemental tank and the sliding shaft 158.

In the ink reservoir unit 12 constructed as described above, when the supplemental tank 151 is inserted in the main tank 121, an ink passage leading from the ink reservoir 153 of the supplemental tank through the coupler 154 to the ink reservoir 127 in the main tank is formed. Also, an air passage leading from the atmosphere hole 139 through the communication hole 138, the communication hole 137, the ink reservoir 127 in the main tank, the passage 134, the passage 141, the communication hole 167, the communication hole 166 and the communication hole 162 of the supplemental tank to the ink reservoir 153 in the supplemental tank is formed. As a result, the ink filling the ink reservoir 153 of the supplemental tank flows into the ink reservoir 127 in the main tank 121. The inflow of the ink is continued and the liquid level of the ink having flowed into the ink reservoir 127 of the main tank gradually rises and the liquid level of the ink is held at a position as shown, thus assuming a balanced state. At this time, the following equation of balance is obtained:

$$P1 = P2 + h\rho g,$$

where P1 is the air pressure of the void in the ink reservoir 127 of the main tank, P2 is the air pressure of the void in the ink reservoir 153 of the supplemental tank, h is the difference between the liquid level of the ink in the ink reservoir 127 and the liquid level of the ink in the passage 141, and $\rho$ is the density of the ink.

Since the ink reservoir 127 is in communication with the atmosphere, P1 is equal to the atmospheric pressure.

Thereafter, even if the ink in the ink reservoir 127 of the main tank is supplied to the ink jet head through the supply hole 128 and the liquid level of the ink in the passage 141 falls temporarily, the air from the atmosphere hole 139 is supplied into the ink reservoir 153 of the supplemental tank through the passage 141 and a predetermined amount of ink again flows into the main tank.

In this manner, the liquid level of the ink in the ink reservoir 127 of the mean tank is kept constant as long as the replenishment of the ink is continued. Accordingly, if the nozzle position of the ink jet head is kept at a predetermined level relative to this liquid level of the ink, the ink tank side can be kept in a predetermined negative pressure condition relative to the nozzle side.

Thus, in the ink reservoir unit in the present embodiment, interchange of ink and air is not effected through the coupler 154 with the inserted supplemental tank as has heretofore been done, but only the supply of ink is effected through the coupler 154 and air is supplied through an air passage provided separately. As a result, only the ink flows through the coupler 154 and therefore, the diameter of the passage therein can be made small. Also, the stroke of this coupler during the insertion of the supplemental tank can be made small, thus avoiding the drawback of a great amount of ink adhering the so coupled portion during the mounting or dismounting of the supplemental tank. Further, the tip end of the coupler of the supplemental tank is not in contact with the liquid surface of the ink in the main tank and therefore, it never happens that a great amount of ink adheres to the tip end of the coupler when the supplemental tank is removed. Further, the diameter of the hole of the coupler can be made small as described above and therefore, it neither happens that the residual ink drops from the tip end of the coupler due to the surface tension of the ink when the supplemental tank is removed. In addition, the air passage provided separately can be freely formed to a size which enables suitable circulation of the air.

The ink pump 41 will now be described by reference again to FIG. 2. Reference numeral 411 designates a bellows, reference numeral 412 denotes an actuator, reference numeral 413 designates a plunger, and reference numeral 414 denotes a return spring interposed between the actuator 412 and the plunger 413. In the deenergized condition of the plunger 413, the actuator 412 is biased to a position in which it compresses the bellows a predetermined amount, by the spring force of the return spring 414. Reference numeral 415 designates an ink chamber formed by the bellows 411. This ink chamber 415 is in communication with an ink pipe 417 disposed in a pipe holder 416. Reference numeral 421 denotes a check valve comprising two duck bill type check valves 422 and 423 connected together in a forward direction as shown. The liquid chamber 424 of the check valve 421 is in communication with the ink pipe 417. Reference numeral 425 designates a supply pipe having one end thereof fitted into the ink supply hole 129 in the bottom plate of the main tank and the other end thereof connected to the inflow side of the check valve 421. A by-pass pipe 426 is connected to the outflow side of the check valve 421. Reference numeral 427 denotes a check valve fitted in the supply hole 128 in the bottom plate 126 of the main tank. A valve 428 maintains its inclined state as shown to cause the ink to circulate in the forward direction and, when a backflow occurs, this valve 428 becomes seated on a valve seat 429 to prevent the backflow. This check valve 427, unlike the duck bill type check valves 422 and 423, has a characteristic that the resistance in the forward direction is small. Connected to the outflow side of the check valve 427 are the by-pass pipe 426 and the ink pipe 13.

Normal ink supply passes from the ink reservoir 127 to the head units 4Y–4Y' through the check valve 427 and the ink pipe 13 in succession. In this manner, the ink is supplied through the check valve 427 having a small resistance in the forward direction and therefore, ink supply toward the ink jet heads can be accomplished under a suitable supply pressure.

On the other hand, when the ink jet heads are to be filled with ink such as when ink is forcibly introduced into the liquid chambers 5Y–5Y' (see FIG. 1) of the ink jet heads if the liquid chambers have become empty, ink supply is effected under a predetermined pressure in the following manner. The plunger 413 is energized to attract the actuator 412 against the spring force of the return spring 414. As a result, the volume of the liquid chamber 415 is increased and therefore, the ink in the ink reservoir 127 of the main tank is sucked from the ink supply hole 129 into the liquid chamber 415 through the check valve 422, the liquid chamber 424 and the ink pipe 417. At that time, the ink in the ink pipe 13 does not flow back because the duck bill type check valve 423 is interposed between the ink pipe 13 leading to the head units 4Y–4Y' and the ink pipe 417 providing a good checking characteristic.

When the plunger 413 is then deenergized again, the actuator 412 is returned to its original position by the return force of the return spring 414. As a result, under a predetermined pressure, the ink sucked as described above is supplied toward the liquid chambers 5Y–5Y' of the head units 4Y–4Y' through the ink pipe 417, the check valve 424, the by-pass pipe 426 and the ink pipe 13Y. Thus, recovery of the heads is effected. At this time, the ink does not flow from the ink pipe 417 back to the ink reservoir 127 because the duck bill type check valve 422 is interposed between the ink pipe 417 and the ink supply pipe 425 leading, the ink reservoir 127 to providing a high checking characteristic.

Thus, in the present embodiment, in effecting ink supply under the predetermined pressure by the ink pump as pressurizing means in the ink supply system, use is made of a combination of a check valve having a high checking characteristic and a check valve having a small resistance in the forward direction, whereby even during the normal ink supply or during the ink supply under the pressure by the pump, proper ink supply can always be accomplished. That is, it is possible to correct the disadvantage of the duck bill type check valve that its checking characteristic is excellent but its resistance in the forward direction is too great, thereby constructing an ink supply mechanism having a required checking characteristic and a required resistance in the forward direction.

During the pressurization by the pump as described above, the group of head units 4 is returned to the second home position and the nozzles of the head units are brought into intimate contact with the cleaning pads 21Y-2–21Y'-2 to cause these cleaning pads to absorb the ink overflowing from the nozzles as by being excessively supplied to the liquid chambers 5Y–5Y' of the heads.

Figure 3:
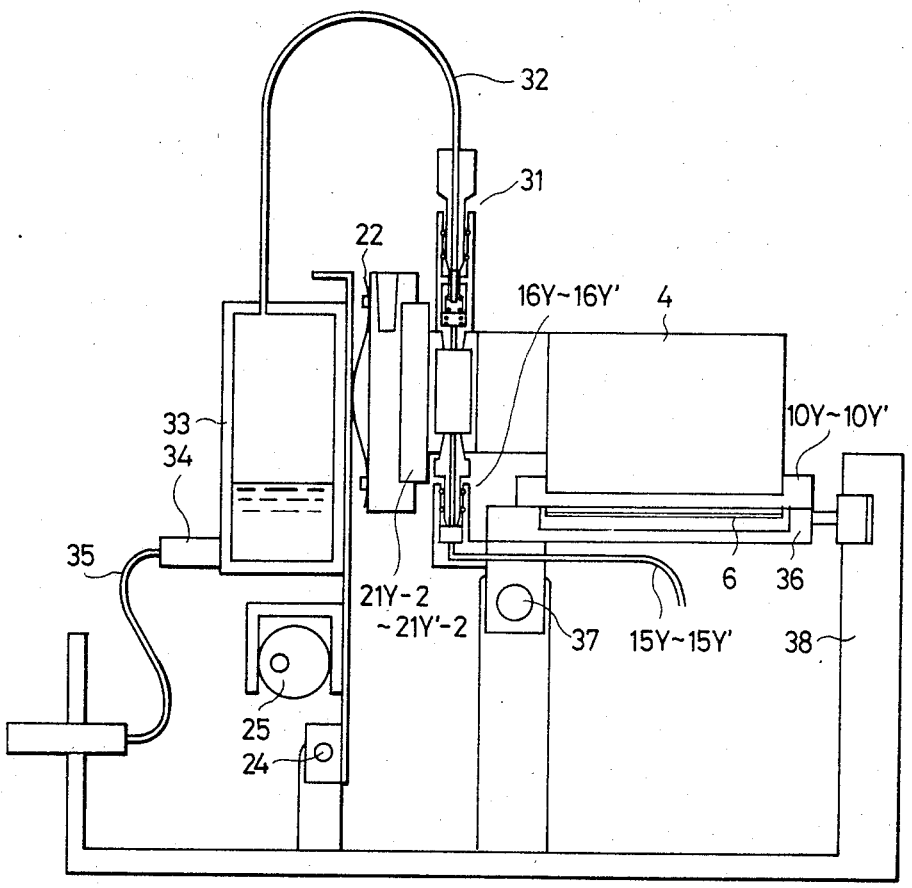
FIG. 3 shows the construction of the head recovering system of FIG. 1.

FIG. 3 shows the recovering system in such condition. In FIG. 3, reference character 31(31Y–31Y') designates discharge couplers which communicate suction pipes 32(32Y–32Y') with the liquid chambers 5Y–5Y', respectively. Reference numeral 33 denotes a drain tank in which is stored the ink discharged from the liquid chambers 5Y–5Y' through the suction pipe 32. Reference numeral 34 designates a coupler which communicates a waste liquid pipe 35 with the drain tank 33. The ink stored in the drain tank 33 may be discharged through the waste liquid pipe 35. In FIG. 3, reference numerals 36, 37 and 38 respectively designate the carriage of the group of head units 4 not shown in FIG. 1, the sliding shaft of the carriage and a carriage guide.

FIG. 4 shows a distributor 14(14Y–14B) for distributing into the ink pipes 15Y, 15Y', 15M, 15M', 15C, 15C' and 15B, 15B' the ink supplied from the ink reservoir units 12(12Y–12B) through the ink pipes 13(13Y–13B).

FIG. 4(1) shows a longitudinal cross-section of the distributor. In FIG. 4(1), reference numeral 51 designates a housing, and reference numeral 52 denotes a change-over valve fitted in this housing for rotation about an axis 53. Reference numeral 54 designates a communication pipe extending through the housing 51 to communicate the liquid chamber 55 of the change-over valve 52 with the ink pipe 13. Reference numerals 56 and 57 designate outflow holes for permitting outflow of the ink from the liquid chamber 55, reference numeral 58 denotes a communication pipe which communicates the outflow hole 56 with the ink pipe 15(15Y–15B) when the change-over valve rotates by a predetermined amount, and reference numeral 59 designates a communication pipe which communicates the outflow hole 57 with the ink pipe 15'(15Y'–15B') when the change-over valve 52 rotates by a predetermined amount. Reference numerals 60, 61 and 62 denote O-rings which seal the space between the housing 51 and the change-over valve 52.

FIGS. 4(2) and 4(3) show the positional relation between the outflow hole 56 and the communication pipe 58 and between the outflow hole 57 and the communication pipe 59, respectively. As can be seen from these Figures, the outflow holes 56 and 57 are formed at positions shifted by predetermined angles about the axis 53, so that when the end surface 63 of the outflow hole 56 is in the position as shown in FIG. 4(2), the liquid chamber 55 and the communication pipe 59 are shut off as shown in FIG. 4(3). On the other hand, when the change-over valve 52 rotates in the direction of the arrow from its position shown and the end surface 64 of the outflow hole 57 comes to a position 65 indicated by broken line in FIG. 4(3), the liquid chamber 55 and the communication pipe 58 are shut off. As a result, as the change-over valve 52 is rotated in the direction of arrow from its position shown, the outflow hole 57 gradually changes from its fully closed condition to its fully open condition.

On the other hand, as regards the outflow hole 56, after its fully open condition is continued, the end surface 66 comes to a position 67 indicated by broken line in FIG. 4(2), and thereafter the opening area of the outflow hole 56 decreases gradually. Thereafter, when the end surface 64 of the hole 57 comes to the broken-line position 65 as shown in FIG. 4(3), the outflow hole 56 becomes fully closed.

In the distributor 14 thus constructed, if the change-over valve 52 is rotated over the range in which the outflow holes 56 and 57 change from their fully open condition to their fully closed condition, the ink having passed to the liquid chamber 55 through the ink pipe 13 can be supplied at a desired flow rate to the head units 4Y–4B and 4Y'–4B' through the ink pipes 15 and 15'. That is, the supply of ink to two head units effecting discharge of the ink of the same color can be accomplished at an optimum flow rate suited for the characteristic of the heads of such head units. Further, when the ink pipe 13 has been removed for maintenance or check-up, if the change-over valve 52 is rotated so that both of the outflow holes 56 and 57 become fully closed, the backflow of the ink from the head unit side through the ink pipes 15, 15' can be prevented.

According to the present invention, as has been described above, in a multicolor recording apparatus provided with a plurality of recording heads of the same color, a distributor is provided between the recording heads of the same color and the ink tank and therefore, supply of ink of the same color from the same ink tank to the plurality of recording heads of the same color can be accomplished simply and suitably.

We claim:

1. A multicolor recording apparatus comprising:

a plurality of independently drivable recording means of the same color; and a distributor for distributing and supplying recording liquid of said color to said plurality of recording means of the same color, said distributor including a plurality of communication holes for distributing and supplying the recording liquid to the respective said recording means, the opening areas of said communication holes for the liquid distribution and supply being variable in a predetermined relationship with each other.

2. An apparatus according to claim 1, wherein that said distributor has a liquid chamber to which said recording liquid of the same color is supplied and a plurality of communication holes formed in the peripheral wall of a cylinder forming said liquid chamber at different positions relative to the circumferential direction of said cylinder to supply the recording liquid of the same color in said liquid chamber toward respective ones of said recording means of the same color, and the opening areas of said plurality of communication holes are variable by rotating the peripheral wall of said cylinder about the axis of said cylinder.

3. An apparatus according to claim 1, wherein one of said communication holes can be set fully open while the other of said communication holes is set fully closed.

4. An apparatus according to claim 1, wherein all of said communication holes can be set to be fully closed.

5. An apparatus according to claim 1, further comprising a liquid supplying system, said system including:

a liquid reservoir for storing the liquid;

pumping means for pressure supplying the liquid in said reservoir to said recording means;

first means defining a first liquid passage for placing said reservoir in communication with said distributor;

second means defining a second liquid passage for placing said reservoir in communication with said pumping means;

first valve means disposed in said first liquid passage for preventing backflow of the liquid therein toward said reservoir; and second valve means disposed in said second liquid passage for preventing backflow of the liquid therein toward said reservoir, the flow resistance of said first valve means in a forward direction in which the liquid is to be discharged from said reservoir being smaller than that of said second valve means.

6. An apparatus according to claim 5, wherein said liquid supplying system further includes third means defining a third liquid passage for placing said pumping means in communication with said distributor and third valve means disposed in said third liquid passage for preventing backflow of the liquid therein toward said pumping means.

7. An apparatus according to claim 1, further comprising a liquid supplying system, said system including:

a liquid chamber for storing the liquid to be supplied to said recording means;

a container chamber formed above said liquid chamber for receiving a supplemental liquid tank for storing supplemental liquid;

a first communication passage for enabling said liquid chamber to communicate with the atmosphere; a communication hole for engaging with a liquid supplementing passage of the supplemental liquid tank at the time the supplemental liquid tank is placed in said container chamber, so as to supplementally supply liquid into said liquid chamber; and a second communication passage disposed outside of said container chamber for communicating with a communication passage of the supplemental liquid tank so as to place the supplemental liquid tank in communication with said liquid chamber.

8. An apparatus according to claim 7, wherein said liquid supplying system further includes means for enabling said second communication passage to place said liquid chamber in communication with the supplemental tank until the liquid level in said liquid chamber reaches a predetermined value.

* * * * *